United States Patent [19]

Sanders

[11] 4,240,526

[45] Dec. 23, 1980

[54] SAFETY DEVICE FOR FORKLIFTS AND THE LIKE

[76] Inventor: Gloria L. Sanders, 587 W. Westfield, Porterville, Calif. 93257

[21] Appl. No.: 64,004

[22] Filed: Aug. 6, 1979

[51] Int. Cl.[3] ..... B66B 9/20

[52] U.S. Cl. ..... 187/9 R; 74/526; 254/1

[58] Field of Search ..... 187/9 R, 1 R, 8.47, 187/8.49; 414/634, 635, 636; 74/526; 292/288; 248/544; 254/1, 2 B, 8 B

[56] References Cited

U.S. PATENT DOCUMENTS

| | | | |
|---|---|---|---|
| 1,499,280 | 6/1924 | Alheit | 254/94 |
| 2,439,854 | 4/1948 | Lipski | 248/352 |
| 2,839,207 | 6/1958 | Isaacs | 187/9 R |
| 2,875,852 | 3/1959 | Morrell | 187/9 R |
| 3,033,400 | 5/1962 | Smith | 187/9 R |
| 3,086,618 | 4/1963 | Christiansen | 187/9 R |
| 3,975,041 | 8/1976 | Edison | 292/288 |
| 4,012,065 | 3/1977 | Miller | 292/288 |
| 4,061,237 | 12/1977 | Austin et al. | 187/9 R |

*Primary Examiner*—Robert B. Reeves
*Assistant Examiner*—Michael J. Forman
*Attorney, Agent, or Firm*—Huebner & Worrel

[57] ABSTRACT

A safety device for use with a forklift having an elevatable carriage, a vertical guide for the carriage, and a horizontal cross bar mounted on the guide, the device having a pair of members spaced to provide a slot dimensioned for fitted engagement with the cross bar and a portion projecting from the members for supporting the carriage in elevated relation on the guide when the device is in such fitted engagement with the cross bar.

7 Claims, 5 Drawing Figures

SAFETY DEVICE FOR FORKLIFTS AND THE LIKE

BACKGROUND OF THE INVENTION

1. Field of the Invention

The present invention relates to a safety device and more particularly to such a device which is adapted for detachable mounting on a forklift or the like to support the carriage thereof in elevated relation during servicing and repair of the vehicle so as to preclude injury.

2. Description of the Prior Art

Forklifts are well known for use in material handling operations in a wide variety of applications. Although forklifts are available in a multitude of sizes and types, nearly all are characterized by a vertically oriented guide or "mast" upon which the fork or carriage is supported for elevational movement. Vertical positioning of the carriage is achieved by controlled operation of an hydraulic ram. In the service and repair of a forklift it is frequently necessary to raise the carriage to allow access to workmen to portions of the forklift beneath and/or behind the carriage. This is extremely dangerous and has resulted in serious injury and death due to inadvertent release of the carriage during such work. The problem is particularly acute when the hydraulic ram or the various linkages thereof must be repaired since the normal carriage supporting elements are then inoperable.

It is, of course, well-known to support the carriage during such maintenance by chains which engage the carriage and are attached to the mast. However, the use of chains for this purpose is dangerous since the chains have been known to break or slip. In addition, chains are not, of course, adapted to fit a particular forklift and so must be carefully wrapped about the desired portions of the carriage and mast and then secured with hooks or the like. As a consequence, the use of chains is, at best, inconvenient and dangerous.

Therefore, it has long been known that there is a chronic need in the service and repair of forklifts and other such material handling equipment for a device which can be used to eliminate the risk of serious injury and death due to inadvertent release of portions thereof during such work and which can be employed rapidly and dependably without specialized training or particular skills.

SUMMARY OF THE INVENTION

Accordingly, it is an object of the present invention to provide an improved safety device for forklifts and other material handling equipment.

Another object is to provide such a device which will effectively support the carriage of a forklift in an elevated position during maintenance.

Another object is to provide such a safety device which can be rapidly and conveniently attached prior to maintenance work and detached thereafter.

Another object is to provide such a safety device which can economically be manufactured in a variety of forms specifically adapted to forklifts of all sizes and types.

Another object is to provide such a safety device which dependably interlocks portions of a forklift during service and repair thereof so as to preclude injury or death as a result of the inadvertent release of those portions.

Further objects and advantages are to provide improved elements and arrangements thereof in an apparatus for the purposes described which are dependable, economical, durable and fully effective in accomplishing its intended purposes.

DESCRIPTION OF THE PREFERRED EMBODIMENTS

First Form

Figure 1:
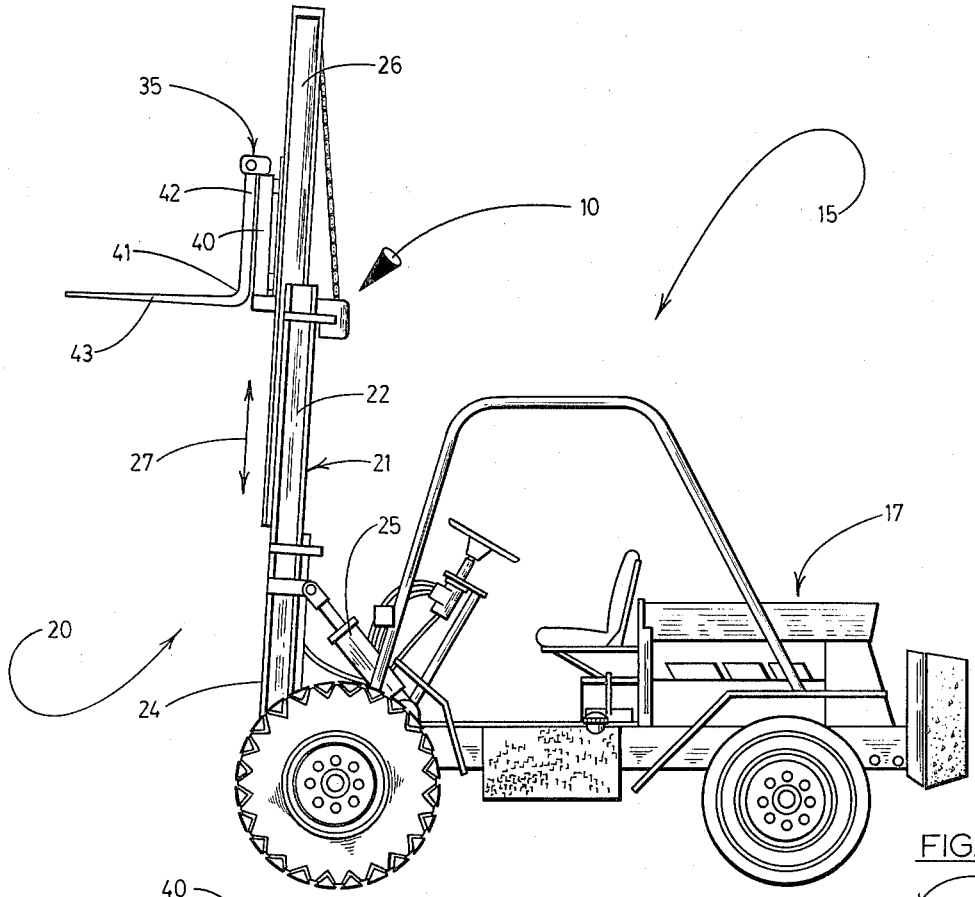
FIG. 1 is a side elevation of a typical operative environment for the first form of safety device embodying the principles of the present invention showing the device mounted in operative position on a forklift.

Referring more particularly to the drawing, the safety device of the first form of the present invention is generally indicated by the numeral 10 in FIG. 1. The device is depicted therein in use on a forklift 15 of typical and well-known construction.

Figure 2:
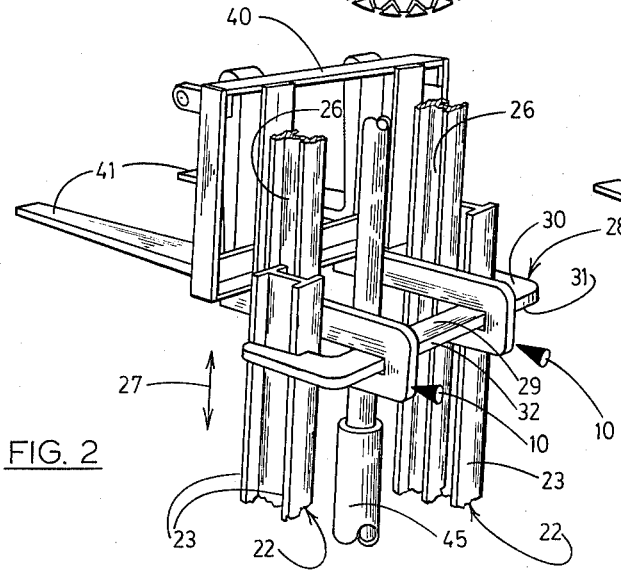
FIG. 2 is a somewhat enlarged, fragmentary perspective view of the forklift of FIG. 1 showing a pair of the safety devices of FIG. 1 in operative position.

It is sufficient to indicate that the forklift 15 shown in FIGS. 1 and 2 has a support or vehicle portion 17 which possesses all of the systems for transporting, powering, and controlling a forward, lift portion 20. The lift portion has a mast 21 composed of a pair of parallel, substantially vertical first rails or guides 22. Typically, the guides are I-beams having flanges 23 and are supported by a frame 24 borne by a hydraulic ram 25 on the vehicle portion. The hydraulic ram can be operated to select the precise vehicle attitude desired for the mast. A pair of parallel second rails or guides 26 are individually, slidably mounted on the first guides and inwardly thereof.

The mast 21 includes a substantially flat cross bar 28 secured, as by welding, on the upper end portions of the guides 22 and disposed in a substantially horizontal attitude. The cross bar has a central portion 29 having an upper surface 30 and a lower surface 31. The central portion of the cross bar has a rearwardly facing edge 32. The cross bar is typically fabricated from a rigid steel plate and retains the upper ends of the guides 22 in spatial relation without obstructing the path of movement of the carriage.

The guides 22 and 26 define a path, indicated by the arrows 27, substantially parallel and forwardly of the guides.

The forklift 10 has an elevatable carriage 35 which is mounted on the guides 22 and 26 for movement along the path indicated by arrows 27. The carriage has a generally rectangular frame 40 mounting a pair of L-shaped members each having a vertical arm 41 pivotally secured near its upper end on the frame, and a horizontal arm 42 for insertion beneath an object to be elevated and moved by the forklift. Typically, the guides 22 and 26 and the carriage are interconnected by rollers or the like, not shown, so that the carriage can move freely along the path between predetermined raised and lowered positions.

A hydraulic ram 45 is mounted on the frame 24 and affixed at its opposite end on the carriage 35. The hydraulic ram is operable in the conventional fashion to raise and lower the carriage for positioning in the desired location along the path indicated by arrows 27.

Figure 3:
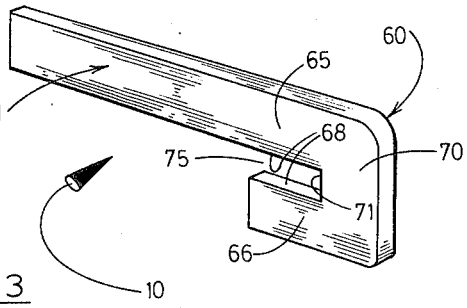
FIG. 3 is a somewhat further enlarged perspective view of the safety device of FIG. 1.

The safety device 10 of the first form of the present invention is best shown in FIG. 3. The device is specifically adapted for use with a forklift 15 having a cross bar disposed in a substantially horizontal attitude as is cross bar 28. The device is a unitary, rigid member which is preferably constructed from steel plate material. The device has a mounting portion 60 which is adapted to be interlocked with the cross bar 28 and has a supporting portion 61 which projects from the mounting portion and is adapted to be engaged by the carriage 35 so as to support the carriage in an elevated position.

The mounting portion 60 of the device 10 is of a generally U-shaped configuration having a pair of rigidly fixed parallel upper and lower jaws 65 and 66 respectively which are of elongated, rectangular form. When the device is mounted on the cross bar 28, as shown in FIG. 2, the jaw 65 is disposed upwardly of the jaw 66 and the longitudinal axes of the jaws are substantially horizontally disposed. The jaws have individual planar edge faces 68 which are disposed in parallel facing relation. The faces 68 of the jaws are spaced so as to permit them to be slidably fitted about the central portion 29 of the cross bar 28 individually engaging the upper and lower surfaces 30 and 31 thereof. The jaws are rigidly interconnected in unitary relation by a section 70 of the mounting portion. Section 70 has a planar edge face 71 which is normal to and interconnects the faces 68 of the jaws. The faces 68 and 71 thus define a rectangular notch or slot 75 dimensioned to conform to the central portion of the cross bar to permit slidable interlocking.

The supporting portion 61 of the safety device 10 is preferably a rectangular extension or elongation of the upper jaw 65 and thus projects horizontally therefrom when the device is mounted on the cross bar 28, as shown in FIGS. 1 and 2. The supporting portion of the device is extended from the mounting portion a distance such that, when the mounting portion is fully engaged on the cross bar, the supporting portion projects forwardly of the guide 22 into and transversely of the path indicated by arrows 27. The supporting portion is thus disposed for engagement by the carriage 35.

As shown in FIG. 2, a pair of the devices 10 are preferably employed as will hereinafter be described.

Second Form

Figure 4:
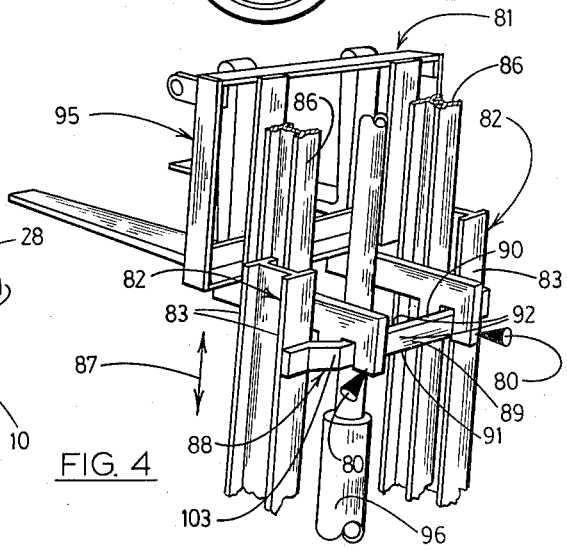
FIG. 4 is a fragmentary perspective view similar to that of FIG. 2 showing a pair of safety devices of the second form of the present invention in operative position on a second type of forklift.
Figure 5:
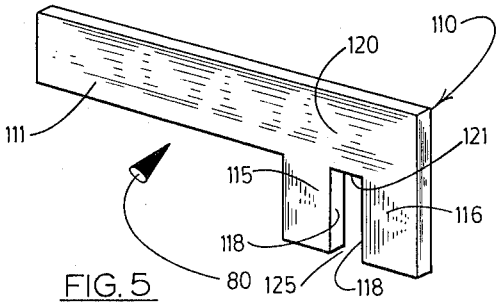
FIG. 5 is a somewhat enlarged perspective view of the safety device of FIG. 4.

The safety device of the second form of the present invention is depicted in FIGS. 4 and 5 and is generally indicated by the numeral 80 therein. The device is for use with a forklift 81 which is virtually identical to forklift 15. Thus, forklift 81 has first rails or guides 82, having flanges 83, and borne in upright, parallel relation by a frame, not shown, on the forklift. A hydraulic ram, not shown, supports the frame on the forklift for precise adjustment of the upright attitude of the guides 82. Second rails or guides 86 are individually mounted on the guides 82 for slidable movement therealong. The guides define a path forwardly and substantially parallel thereto indicated by arrows 87 in FIG. 4. These elements of forklift 81 are substantially identical to the corresponding elements of forklift 15.

However, the cross bar 88 of forklift 81 is secured on and extends between the upper ends of the guides 82 in a substantially vertical orientation as shown in FIG. 4. The cross bar 88 is of rigid steel construction having a central portion 89 which extends between the guides 82. The central portion of the cross bar has a substantially horizontal upper edge surface 90 and an opposite, substantially parallel lower edge surface 91. The central portion has opposite sides 92. Insofar as the present invention is concerned, the significant difference between the cross bar 28 and the cross bar 88 is that the longitudinal axis of the central portion 29 of the cross bar 28 is substantially horizontally disposed while the corresponding axis of the central portions 89 of the cross bar 88 is substantially vertically disposed.

It will be understood that insofar as significant to the device 80 of the present invention, the forklift 81 is identical to forklift 15 except as previously noted. Thus, the forklift 81 has a carriage 95 mounted on the guides 82 and 86 for movement along the path indicated by arrows 87. An hydraulic ram 96 interconnects the frame 84 and the carriage for movement of the carriage along the path between predetermined raised and lowered positions.

The safety device 80 has a mounting portion 110 and a supporting portion 111 which have the same functions as the corresponding portions 60 and 61 of device 10. The device 80, as in the case of device 10, is preferably constructed of steel plate and is of rigid unitary construction. The mounting portion of the device 80 is generally U-shaped having a pair of parallel, rectangular jaws 115 and 116. These jaws have individual planar edge faces 118 disposed in spaced, substantially parallel facing relation. The jaws are rigidly interconnected in unitary relation by a second 120 of the mounting portion. The section has an edge face 121 which is normal to and interconnects the faces thereof. The faces 118 are spaced so that they are adapted to be individually slidably received about the vertical sides 92 of the cross bar 88. The edge faces 118 and 121 thus define a rectangular notch or slot 125 dimensioned to conform to the central portion 89 of the cross bar 88 and vertically oriented when the device 80 is disposed in the attitude shown in FIG. 5. In this attitude, the slot faces downwardly with the edge face 121 rested on the upper edge surface 90 of the cross bar 88.

The supporting portion 111 of the device 80 is similar to the corresponding portion 61 of the device 10 of the first form of the present invention. However, as best shown in FIG. 5, the supporting portion of the device 80 forms an extension of elongation of the section 120 and projects therefrom at the end thereof adjacent to the jaw 115. The length of the supporting portion is such that, when the mounting portion is engaged with the cross bar 88 in the manner described, the supporting portion projects horizontally from the mounting portion 110 through and transversely of the path indicated by arrows 87 for engagement by the carriage 95.

OPERATION

The operation of the described embodiments of the subject invention are believed to be clearly apparent and are briefly summarized at this point.

Preferably, a pair of safety devices 10 of the first form of the present invention are utilized, as shown in FIGS. 1 and 2, to support the carriage 35 at approximately the height of the cross bar 28. The carriage 35 is first elevated along the path indicated by arrows 27 until the frame 40 is disposed substantially upwardly of the cross bar 28. The devices 10 are then slidably mounted on the central portion 29 of the cross bar individually, inwardly adjacent to the second guides 26. Each device is mounted by sliding the mounting portion 60 thereof about the central portion so that the central portion is received in its slot 75. Such movement is continued until the edge face 71 of the device engages the edge 32 of the cross bar 28. When so mounted, the jaws 65 and 66 embrace the cross bar and engage its upper and lower surfaces 30 and 31 respectively so that the device cannot rotate in a vertical plate or move vertically in relation to the cross bar. When the devices are so mounted, their supporting portions 61 project horizontally beneath the carriage 35. The carriage is subsequently lowered until it engages and is rested upon the supporting portions. The carriage is thus constrained from further downward movement along the path indicated by arrows 27.

When the carriage 35 is supported in the safety devices 10 in the manner described, the weight of the carriage creates downward pivotal pressure by the devices on the cross bar 28 which is immovable. The reaction forces generated between the bar and the devices create a binding effect therebetween effectively to retain the devices in position on the cross bar. This action prevents the devices from slipping from the cross bar. The carriage is thus dependably and safely supported in the elevated position so that maintenance work can be performed therebeneath. When the carriage is supported on the devices, the ram 45 is no longer required to support the carriage. Thus, such maintenance work can extend to removal of the ram or to work on other elements of the forklift 15 which are normally required to elevate the carriage.

When the maintenance which required elevation of the carriage 35 has been completed, the carriage is raised slightly, using the ram 45, from its position rested on the supporting portions 61 of the safety devices 10. When the carriage is thus raised, the devices are no longer bound on the cross bar 28. Each device is then slidably removed from the cross bar freeing the forklift 15 for normal use.

The operation of the safety device 80 of the second form of the present invention is similar to that just described for device 10. The carriage 95 is first elevated to a position substantially above the cross bar 88. A pair of the devices 80 are then mounted on the cross bar so that the devices are mounted in position by disposing its slot 125 above the central portion 89 of the cross bar with the supporting portion 111 of the device extending horizontally through the path indicated by the arrows 87 and beneath the carriage. The mounting portion is then moved downwardly about the cross bar so that the central portion 89 thereof is received in the slot and until the edge face 121 engages the upper edge surface 90 of the cross bar. The carriage is then lowered onto the supporting portions of the devices. The devices 80 are thus retained on the cross bar by the weight of the carriage by the action previously described in connection with device 10. The carriage is thus dependably and safely supported on the devices and maintenance can be performed beneath the carriage.

When such maintenance is complete, the carriage 95 is elevated sufficiently to disengage it from the devices. The devices are then slidably detached from the cross bar 88. The forklift 81 is thereafter available for normal use.

The devices 10 and 80 are economical to manufacture. It is thus practical to provide each forklift in any given business with a pair of the devices. As previously described, the devices afford a simplicity and dependability of operation. As a result, each forklift can be equipped with a pair of the devices and they can be used in the service and repair of forklifts with virtually no special training and without the temptation to perform such work without using the devices.

The construction of the devices 10 and 80 has been found sufficiently strong to prevent breakage or serious distortion due to the weight of the carriage so that structural failure of the devices will not occur. It has been found that the devices will withstand abusive treatment without damage in any respect approaching that which might cause structural failure.

Therefore, the safety device of the present invention can expeditiously and conveniently be installed on and removed from forklifts of virtually any type and in considerably less time than is required for conventional devices thereby encouraging its use and reducing to an absolute minimum the risk of injury or death in the service or repair of such vehicles.

Although the invention has been herein shown and described in what are conceived to be the most practical and preferred embodiments, it is recognized that departures may be made therefrom within the scope of the invention, which is not to be limited to the illustrative details disclosed.

Having described my invention, what I claim as new and desire to secure by Letters Patent is:

1. A safety device for use on a forklift or the like having a substantially vertical guide defining a path of travel, a carriage, means mounting the carriage for movement along the path of travel and a substantially horizontal cross member rigidly mounted on a portion of the forklift adjacent to the path of travel, and being at all times out of said path of travel the device comprising a mounting member having a slot having a dimension slightly larger than the cross member permitting fitted engagement with the cross member in supported, non-rotational relation; and a supporting member integral with and extending from said mounting member in an attitude such as to extend into said path of travel for engagement by the carriage when the mounting member is disposed in said fitted engagement.

2. The safety device of claim 1 wherein said slot is substantially parallel to the supporting member.

3. The safety catch of claim 1 wherein said slot is substantially right-angularly related to the supporting member.

4. A safety device for use with a forklift having an elevatable carriage, a substantially upright guide having a lower end and defining a path along which the carriage is elevated; and a substantially flat cross bar rigidly mounted on the guide upwardly of said lower end being at all times out of said path the device being adapted for detachable mounting on the cross bar to support the carriage upwardly of said lower end and comprising a rigid unitary member having A. a pair of jaws dimensioned and spaced from each other a distance slightly larger than the cross bar slidably to embrace the cross bar in non-rotational relation; and B. a supporting portion extending from the pair of jaws in an attitude to extend across said path in receiving relation to the carriage when the jaws embrace the cross bar.

5. The safety device of claim 4 wherein the cross bar of the forklift is substantially rectangular, having a pair of opposite sides and an edge interconnecting said sides; and wherein the jaws of the device have individual, substantially parallel faces disposed in facing relation for individual slidable engagement with said sides of the cross bar, and the device has a face interconnecting said faces of the jaws for abutment with the edge of the cross bar.

6. The safety device of claim 5 wherein the opposite sides of the cross bar are substantially vertical and wherein said interconnecting face is substantially parallel to the supporting portion of the device and the faces of the jaws are substantially normal to the supporting portion.

7. The safety catch of claim 5 wherein the opposite sides of the cross bar are substantially horizontal and wherein the interconnecting face is substantially normal to the supporting portion and the faces of the jaws are substantially parallel to the supporting portion.

* * * * *